US007954429B1

(12) United States Patent
Abukhdair

(10) Patent No.: US 7,954,429 B1
(45) Date of Patent: Jun. 7, 2011

(54) COMBINED INK STAMP AND DIGITAL COUNTER DEVICE AND ASSOCIATED METHOD

(76) Inventor: Hatim Abukhdair, Tampa, FL (US)

( * ) Notice: Subject to any disclaimer, the term of this patent is extended or adjusted under 35 U.S.C. 154(b) by 415 days.

(21) Appl. No.: 12/154,620

(22) Filed: May 23, 2008

Related U.S. Application Data

(60) Provisional application No. 60/931,186, filed on May 23, 2007.

(51) Int. Cl.
*B41K 1/36* (2006.01)
*B41K 1/42* (2006.01)
*G07C 3/00* (2006.01)

(52) U.S. Cl. ..... 101/327; 101/333; 101/103; 377/15

(58) Field of Classification Search ..... 101/327, 101/333, 405, 406, 93, 103; 377/15
See application file for complete search history.

(56) References Cited

U.S. PATENT DOCUMENTS

| | | | | |
|---|---|---|---|---|
| 1,465,915 | A | 8/1923 | Komusin | |
| 4,532,642 | A | 7/1985 | Morris | |
| 5,205,214 | A | 4/1993 | Seo | |
| 5,271,322 | A * | 12/1993 | Palma | 101/333 |
| 5,506,876 | A * | 4/1996 | Homer | 377/15 |
| 2003/0047095 | A1 * | 3/2003 | Cho | 101/327 |

FOREIGN PATENT DOCUMENTS

JP 62273880 A * 11/1987

* cited by examiner

*Primary Examiner* — Leslie J Evanisko

(57) ABSTRACT

A combined ink stamp and digital counter device includes a portable self-inking stamp that includes a housing provided with a print head. The device also includes a mechanical print head actuator that is coupled to the print head for urging the print head along a linear reciprocating path defined between an upper resting position and a lower stamping position. The device further includes a counting mechanism that is coupled to the print head actuator and is configured to conveniently count a number of stampings when the print head actuator is displaced to the lower stamping position. The device furthermore includes a display screen that is electrically coupled to the counting mechanism and is configured to display the number of stampings.

12 Claims, 9 Drawing Sheets

COMBINED INK STAMP AND DIGITAL COUNTER DEVICE AND ASSOCIATED METHOD

CROSS REFERENCE TO RELATED APPLICATIONS

This application claims the benefit of U.S. Provisional Application No. 60/931,186, filed May 23, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to ink stamps and, more particularly, to a combined ink stamp and digital counter device for conveniently allowing users to track the amount of stamps that they have made with their ink stamp.

2. Prior Art

The high volume of documents which must be handled in commerce has created a demand for means by which a large number of documents can be handled rapidly. This has led to the development of apparatuses for performing routine operations such as sorting and endorsing. One type of apparatus for placing endorsements upon documents includes stamp for documents that has a rotating stamp head with an integral ink pad within the apparatus. As the stamp head is pushed down towards the document, the stamp is brought into contact with the document and stamps the endorsement in ink thereon. This eliminates the need to repeatedly moving an ink stamp between a separate ink pad and the desired document. Currently, there is no effective means for keeping track of how many documents have had a stamp pressed thereon.

Accordingly, a need remains for a combined ink stamp and digital counter in order to overcome the above-noted shortcomings. The present invention satisfies such a need by providing a device that is convenient and easy to use, is durable yet lightweight in design, is versatile in its applications, and provides a convenient means for users to keep track of the number of mailings sent out at one particular time. Additionally, a plurality of important documents that need to be stamped with a date can effectively be accounted for with expedience and ease. The present invention readily enhances the day-to-day duties of clerical staff, particularly bookkeeping, accounting and auditing clerks, as well as secretaries.

BRIEF SUMMARY OF THE INVENTION

In view of the foregoing background, it is therefore an object of the present invention to provide a device for effectively allowing users to track the amount of stamps that they have made with their ink stamp. These and other objects, features, and advantages of the invention are provided by a combined ink stamp and digital counter device.

In a preferred embodiment of the present invention, a combined ink stamp and digital counter device preferably includes a portable self-inking stamp including a housing provided with a print head. The device may also include a mechanical print head actuator that is coupled to the print head for urging the print head along a linear reciprocating path defined between an upper resting position and a lower stamping position. The print head actuator preferably includes a rectilinear shaft connected to the housing and the rubber imprint area respectively. A first bar traverses the first shaft and is slidably coupled thereto. A spring member has a top end fixedly anchored to the first bar. A second bar is fixedly coupled to the spring member such that the spring member is effectively intercalated between the first and second bars. The rubber imprint area is linearly reciprocated along an axial path when the shaft and the second bar are urged downwardly. The spring member is adapted to an extended position such that the rubber imprint area advantageously automatically returns to equilibrium when the shaft and the second bar are released.

The print head actuator may further include a plurality of teeth formed along a portion of the shaft. A gear is rotatably and continuously interfitted with the teeth and is configured in such a manner that the gear effectively rotates along clockwise and counter clockwise directions when the shaft is upwardly and downwardly displaced respectively.

The device preferably includes a counting mechanism coupled to the print head actuator and is configured to count a number of stampings when the print head actuator is displaced to the lower stamping position. The device may further includes a display screen electrically coupled to the counting mechanism and is configured to display the number of stampings. Such a counting mechanism preferably includes a digital counter and a digital counter interface coupled thereto. The digital counter interface may include a conductive sensor in communication with the printer head actuator, a user interface electrically coupled to the digital counter, and a logic gate electrically coupled to the digital counter that further is in communication with the user interface and the sensor respectively. The conductive sensor generates and transmits true and false input signals to the logic gate when the self-inking stamp is depressed.

The user interface preferably includes void button and reset buttons that generate and transmit respective true input signals to the logic gate when the reset and void buttons are not engaged. The void and reset buttons respectively generate and transmit false input signals to the logic gate when the reset and void buttons are engaged and thereby respectively setting a count of the counting mechanism to zero and canceling a count of the counting mechanism respectively. The digital counter is directly connected to the display screen to visually display the number of stampings.

The logic gate preferably effectively generates and transmits a true output signal to the digital counter when both of the first and second inputs signals are true for adding a count to the number of stampings. The logic gate may also generate and transmit a false output signal to the digital counter when either of the first and second inputs signals are false for subtracting a count from the number of stampings.

The sensor preferably includes a non-linear conductive guide pin statically connected to the gear and protruding outwardly therefrom. The conductive guide pin synchronously rotates along the clockwise and counter clockwise directions with the gear. A non-linear conductive receiving pin is statically coupled to the digital counter interface. The sensor generates the true and false input signals upon detecting an engaged relationship between the conductive guide pin and the conductive receiving pin each time the self-inking stamp is depressed.

The present invention further includes, a method for tracking a number of stamps made by an ink stamp. Such a method preferably includes the steps of providing a housing that has a print head, and providing and coupling a mechanical print head actuator to the print head. Further steps may include providing and coupling a counting mechanism to the print head actuator; providing a display screen electrically coupled to the counting mechanism; and urging the print head along a linear reciprocating path defined between an upper resting position and a lower stamping position. Final steps preferably include the counting mechanism counting a number of stampings when the print head actuator is displaced to the lower stamping position; and conveniently displaying the number of stampings on the display screen.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1A:
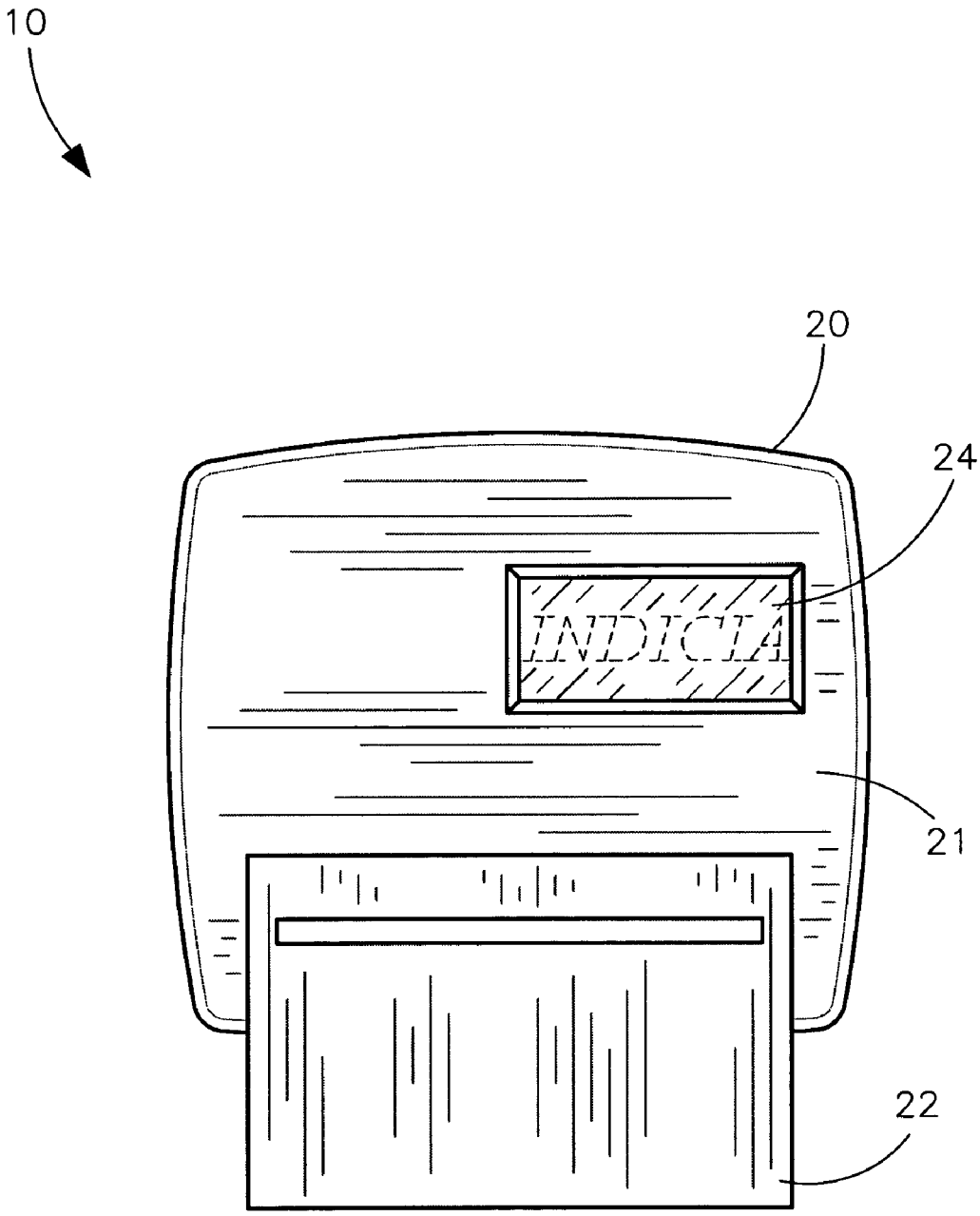
FIG. 1*a* is a front-elevational view showing a combined ink stamp and digital counter device, in accordance with the present invention.
Figure 1B:
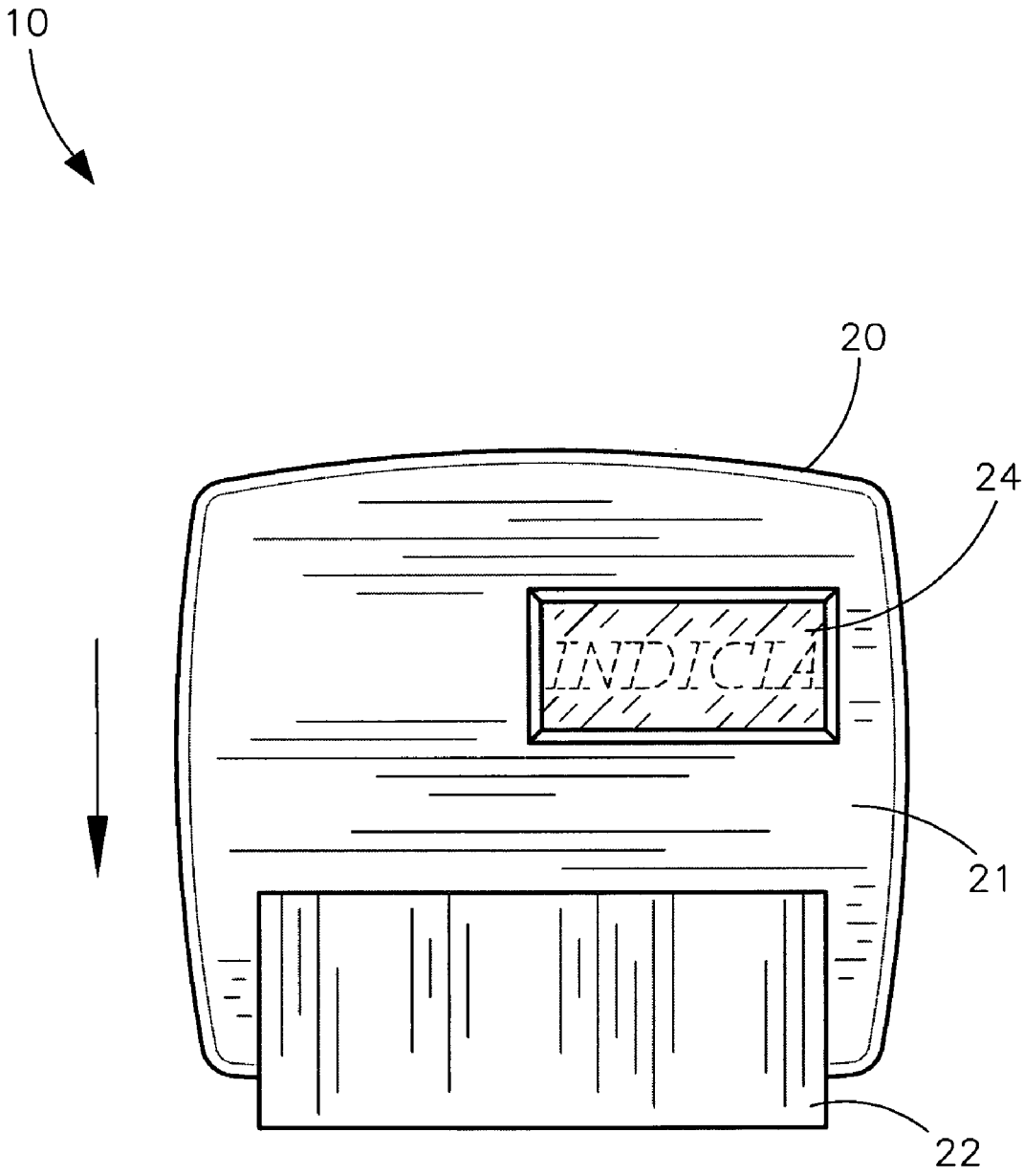
FIG. 1*b* is a front-elevational view of the device shown in FIG. 1, showing the device at a lower stamping position.
Figure 2:
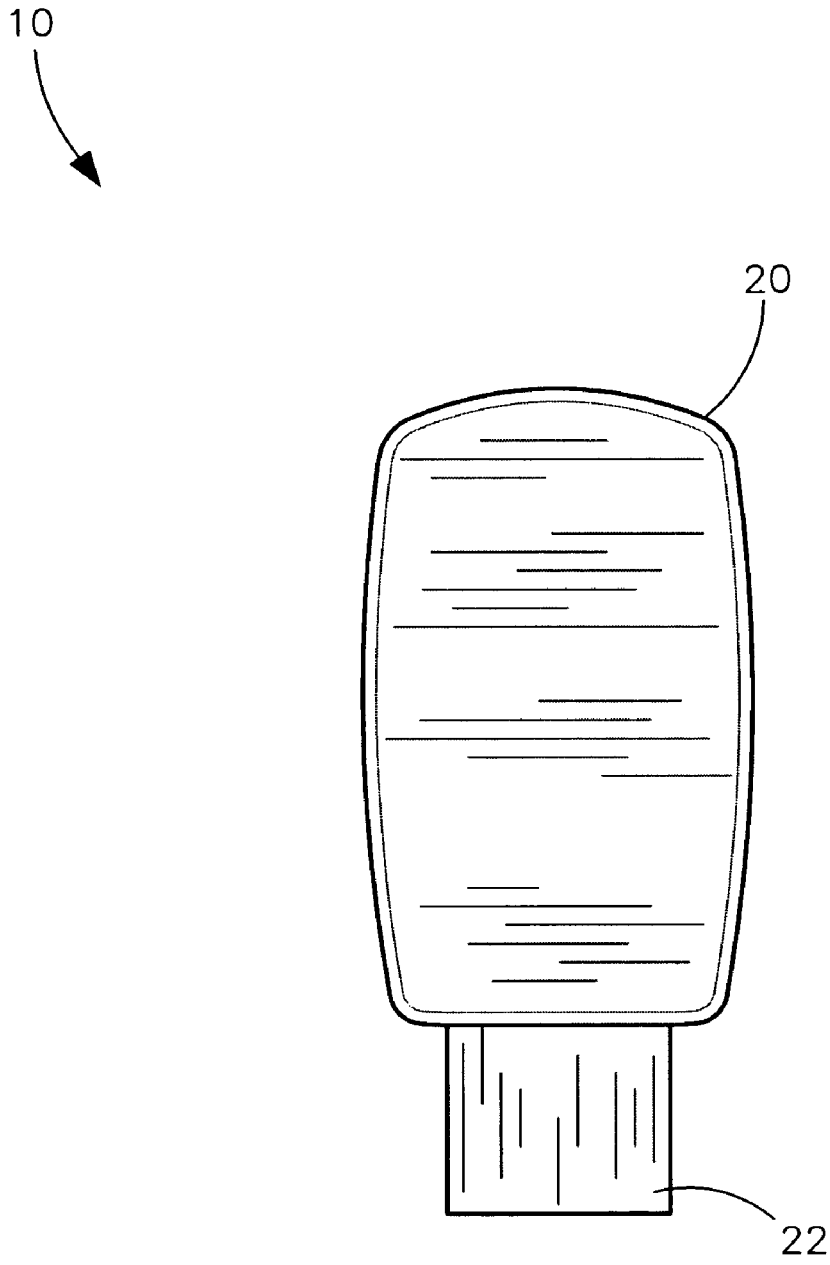
FIG. 2 is side-elevational view of the device shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1*a*-7 by the reference numeral 10 and is intended to provide a combined ink stamp and digital counter device. It should be understood that the device 10 may be used to provide a combined counting means for many different types of reciprocating stamping implements and should not be limited to only being used with reciprocating ink stamps.

Referring initially to FIGS. 1*a* through 7, a combined ink stamp and digital counter device 10 preferably includes a portable self-inking stamp 20 including a housing 21 provided with a print head 22. The device 10 may also include a mechanical print head actuator 30 that is coupled to the print head 22, which is essential for urging the print head 22 along a linear reciprocating path defined between an upper resting position and a lower stamping position (as best shown in FIGS. 3*a* and 3*b*). Such a print head 22 has a rubber imprint area 23 monolithically formed therewith that is important for first receiving ink thereon, and subsequently applying ink to a desired surface as the print head 22 is urged towards the lower stamping position. Of course, the rubber imprint area 23 may have a variety of alphanumerical raised indicia formed thereon for imparting a stamped message to a desired surface, like paper, as is obvious to a person of ordinary skill in the art.

Referring to FIGS. 3*a*, 3*b*, 6 and 7, the print head actuator 30 preferably includes a rectilinear shaft 31 connected to the housing 21 and the rubber imprint area 23 respectively. A first bar 32*a* traverses the first shaft 31 and is slidably coupled thereto. A spring member 33 has a top end 34 fixedly anchored, without the use of intervening elements, to the first bar 32*a*. A second bar 32*b* is fixedly coupled to the spring member 33 such that the spring member 33 is effectively intercalated between the first and second bars 32*a*, 32*b*. The rubber imprint area 23 is linearly reciprocated along an axial path when the shaft 31 and the second bar 32*b* are urged downwardly. The spring member 33 is adapted to an extended position such that the rubber imprint area 23 advantageously automatically returns to equilibrium when the shaft 31 and the second bar 32*b* are released.

Again referring to FIGS. 3*a*, 3*b*, 6 and 7, the print head actuator 30 may further include a plurality of teeth 35 formed along a portion of the shaft 31. A gear 36 is rotatably and continuously interfitted with the teeth 35 and is configured in such a manner that the gear 36 effectively rotates along clockwise and counter clockwise directions when the shaft 31 is upwardly and downwardly displaced respectively. The interfitted relationship between the gear 36 and the plurality of teeth 35 of the shaft 31 provides an unexpected and unpredictable benefit over prior art reciprocating stamps attempts by allowing a stable yet smooth path of travel between the upper resting position and the lower stamping position, which is important for performing uniform and consistent stampings.

Referring to FIGS. 1*a*, 1*b*, 6 and 7, the device 10 preferably includes a counting mechanism 40 coupled to the print head actuator 30 and is configured to count a number of stampings when the print head actuator 30 is displaced to the lower stamping position. The device 10 may further includes a display screen 24 electrically coupled to the counting mechanism 40 and is configured to display the number of stampings. Such a counting mechanism 40 preferably includes a digital counter 41 and a digital counter interface 42 coupled thereto.

The digital counter interface 42 may include a conductive sensor 43 in communication with the printer head actuator 30, a user interface 44 electrically coupled to the digital counter 41, and a logic gate 45 electrically coupled to the digital counter 41 that further is in communication with the user interface 44 and the conductive sensor 43 respectively. The conductive sensor 43 effectively generates and transmits true and false input signals to the logic gate 45 when the self-inking stamp 20 is depressed.

Figure 6:
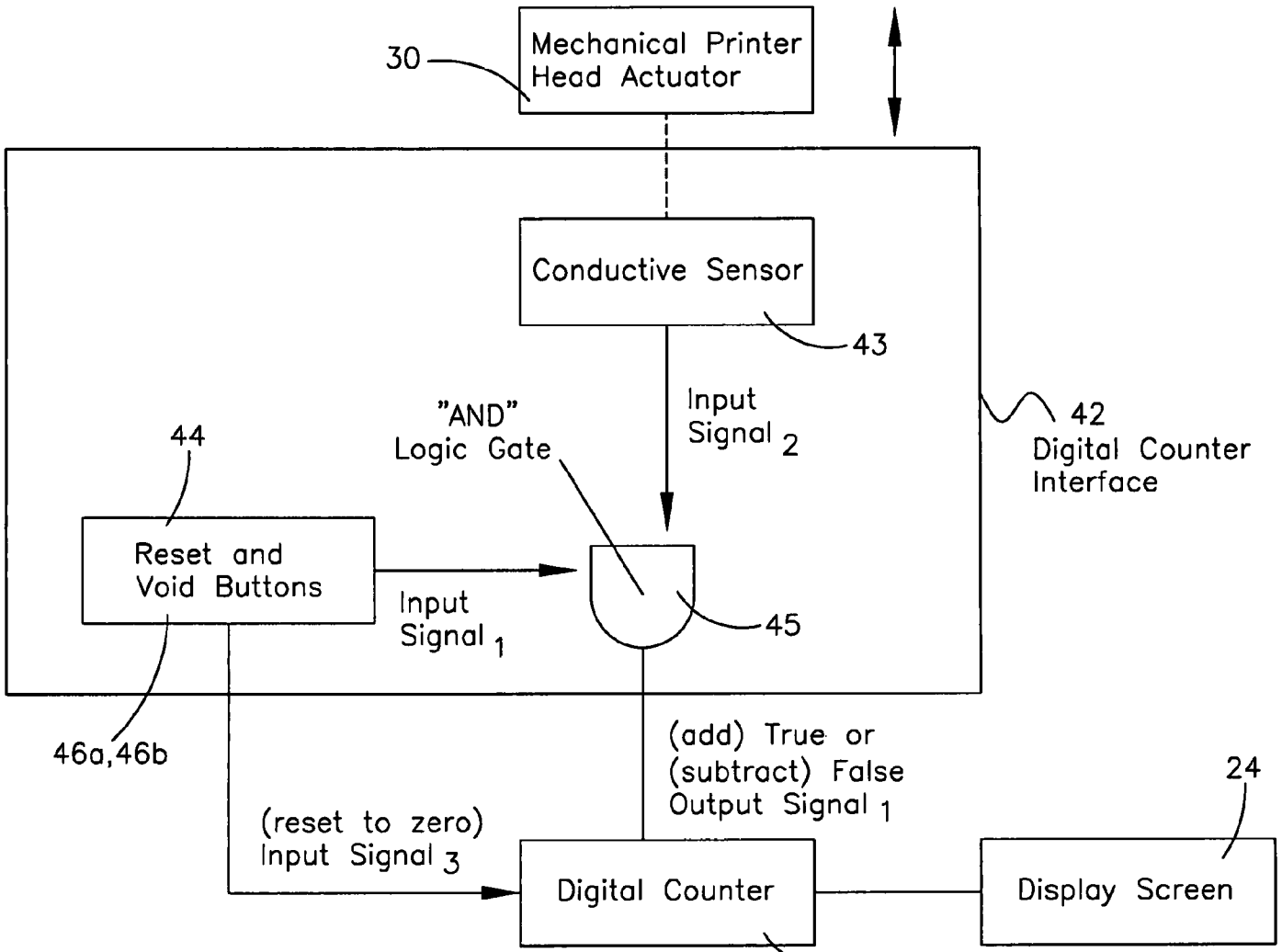
FIG. 6 is schematic block diagram showing the electrical interrelationship between digital counter interface and the remaining components of the present invention.
Figure 7:
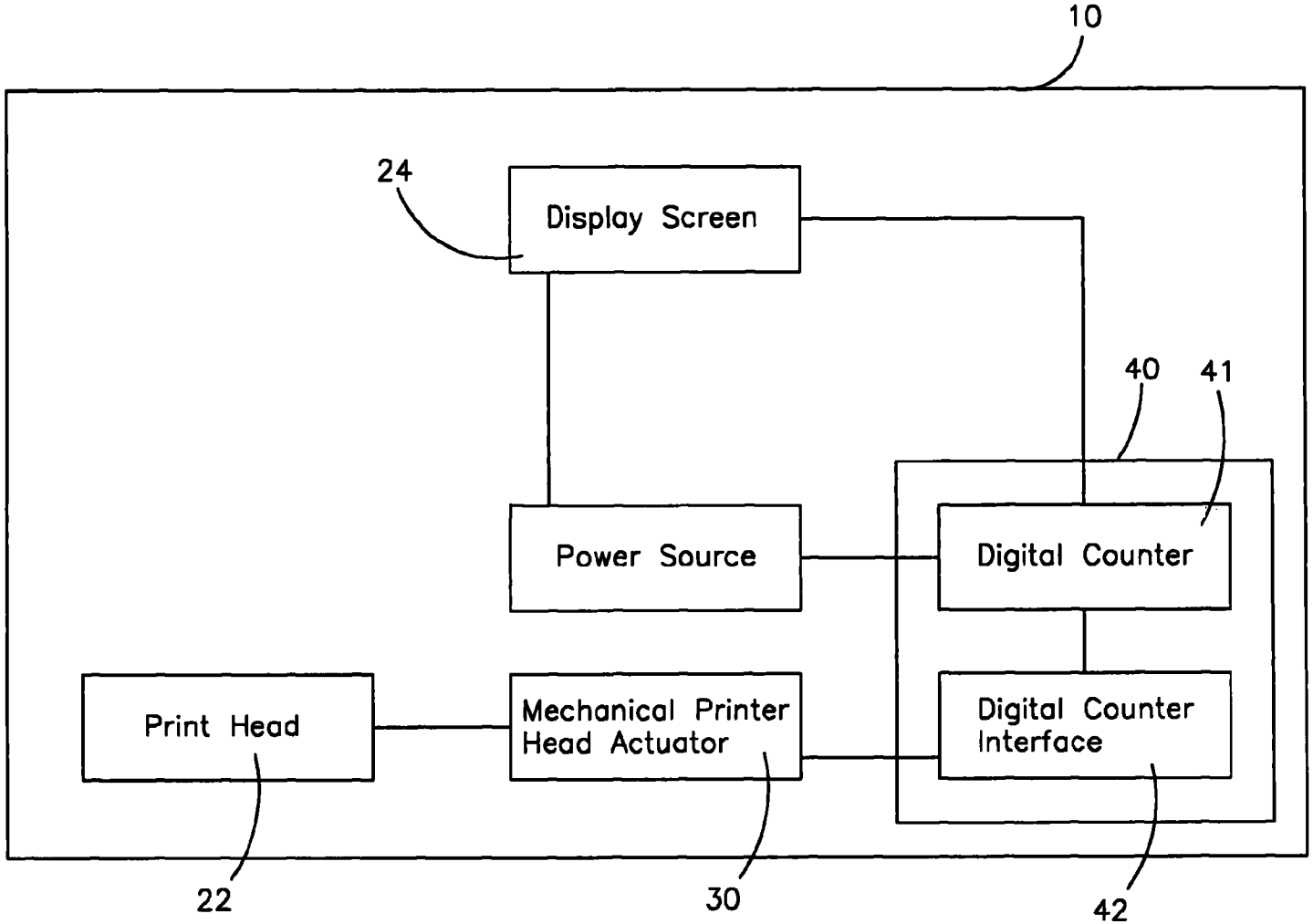
FIG. 7 is a high level schematic block diagram of the device, in accordance with the present invention.

Referring to FIGS. 6 and 7, the user interface 44 preferably includes a void button 46A and a reset button 46B that generate and transmit respective true input signals to the logic gate 45 when the reset and void buttons 46A, 46B are not engaged. The void and reset buttons 46A, 46B respectively generate and transmit false input signals to the logic gate 45 when the reset and void buttons 46A, 46B are engaged and thereby respectively setting a count of the counting mechanism 40 to zero and canceling a count of the counting mechanism 40 respectively. The digital counter 41 is directly connected, without the use of intervening elements, to the display screen 24, which is important and advantageous for visually displaying the number of stampings such that, for example, a user can conveniently keep track of the number of processed documents or the number of clients serviced within a predetermined time period.

Again referring to FIGS. 6 and 7, the logic gate 45 preferably effectively generates and transmits a true output signal to the digital counter 41 when both of the first and second inputs signals are true for adding a count to the number of stampings. The logic gate 45 may also generate and transmit a false output signal to the digital counter 41 when either of the first and second inputs signals are false for subtracting a count from the number of stampings.

Figure 3A:
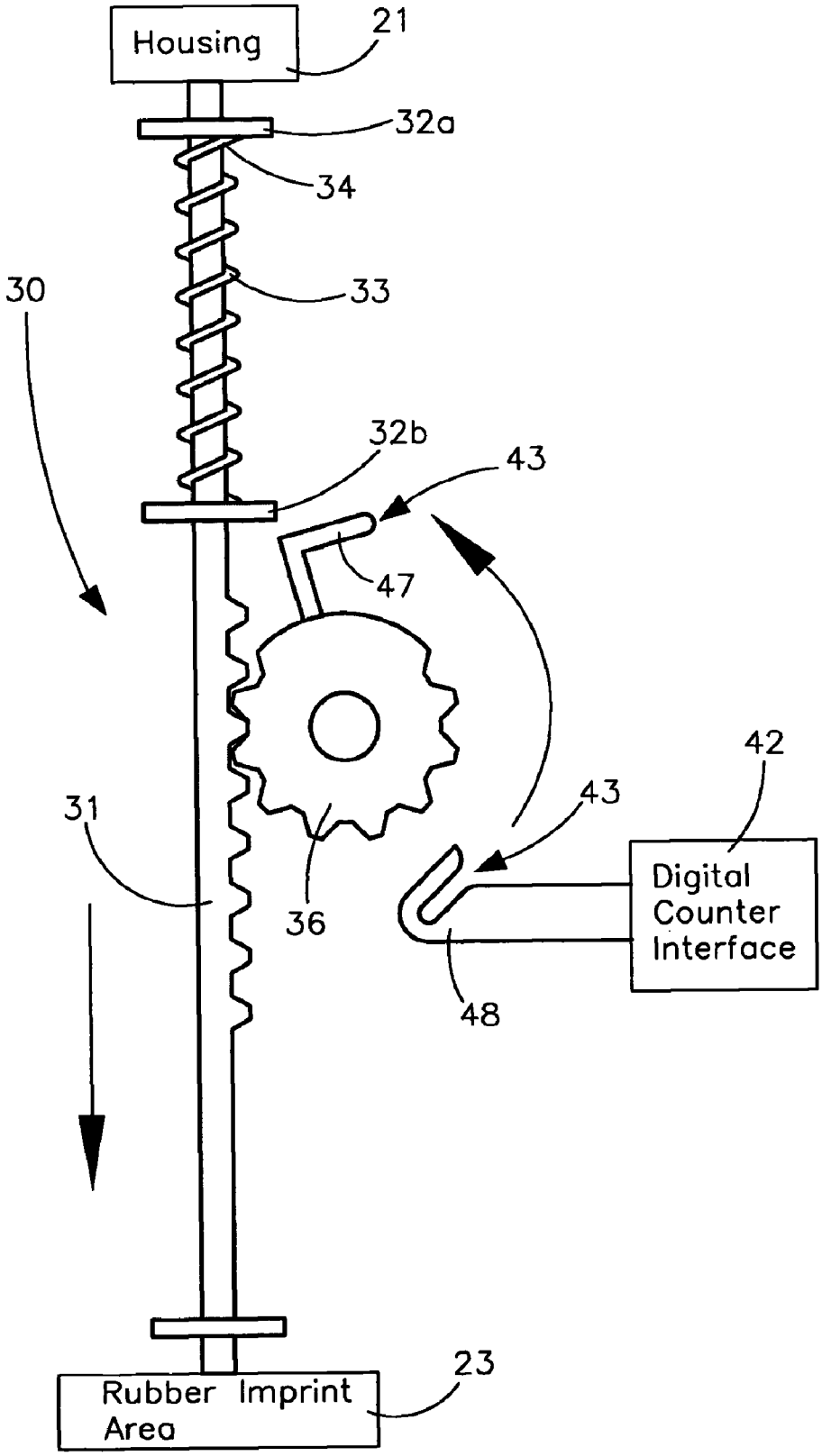
FIG. 3*a* is side elevational view showing the mechanical print head actuator and conductive sensor at a raised and disengaged position respectively.
Figure 3B:
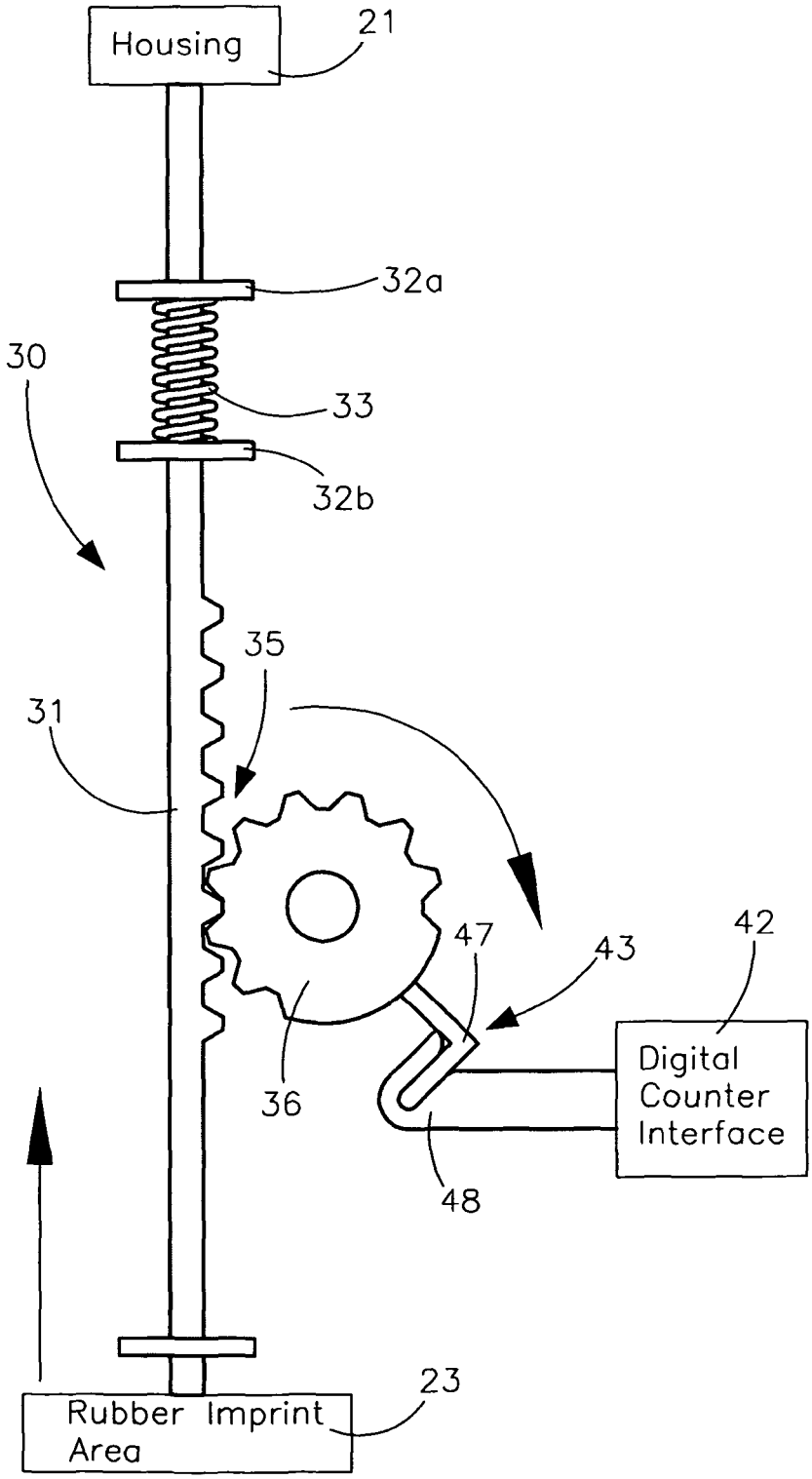
FIG. 3*b* is a side elevational view s the mechanical print head actuator and conductive sensor at a lowered and engaged position respectively.
Figure 4:
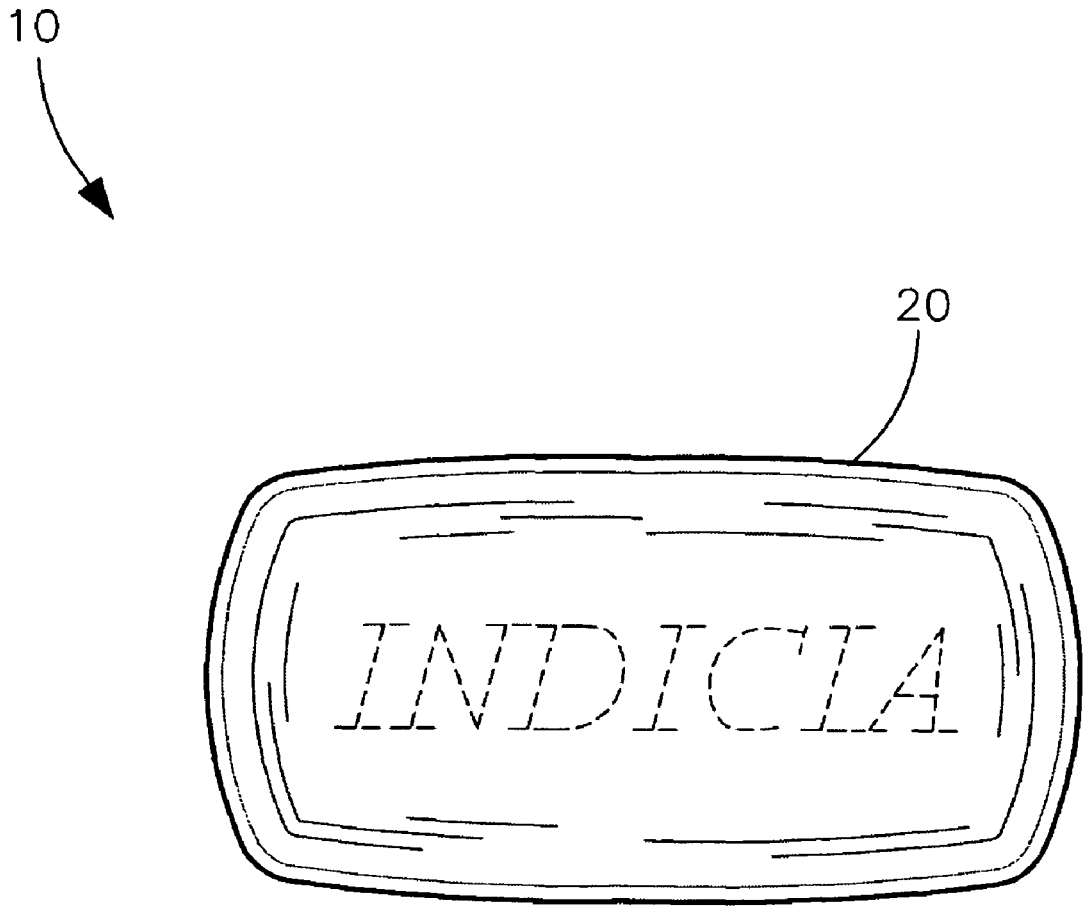
FIG. 4 is a top-plan view of the device shown in FIG. 1.
Figure 5:
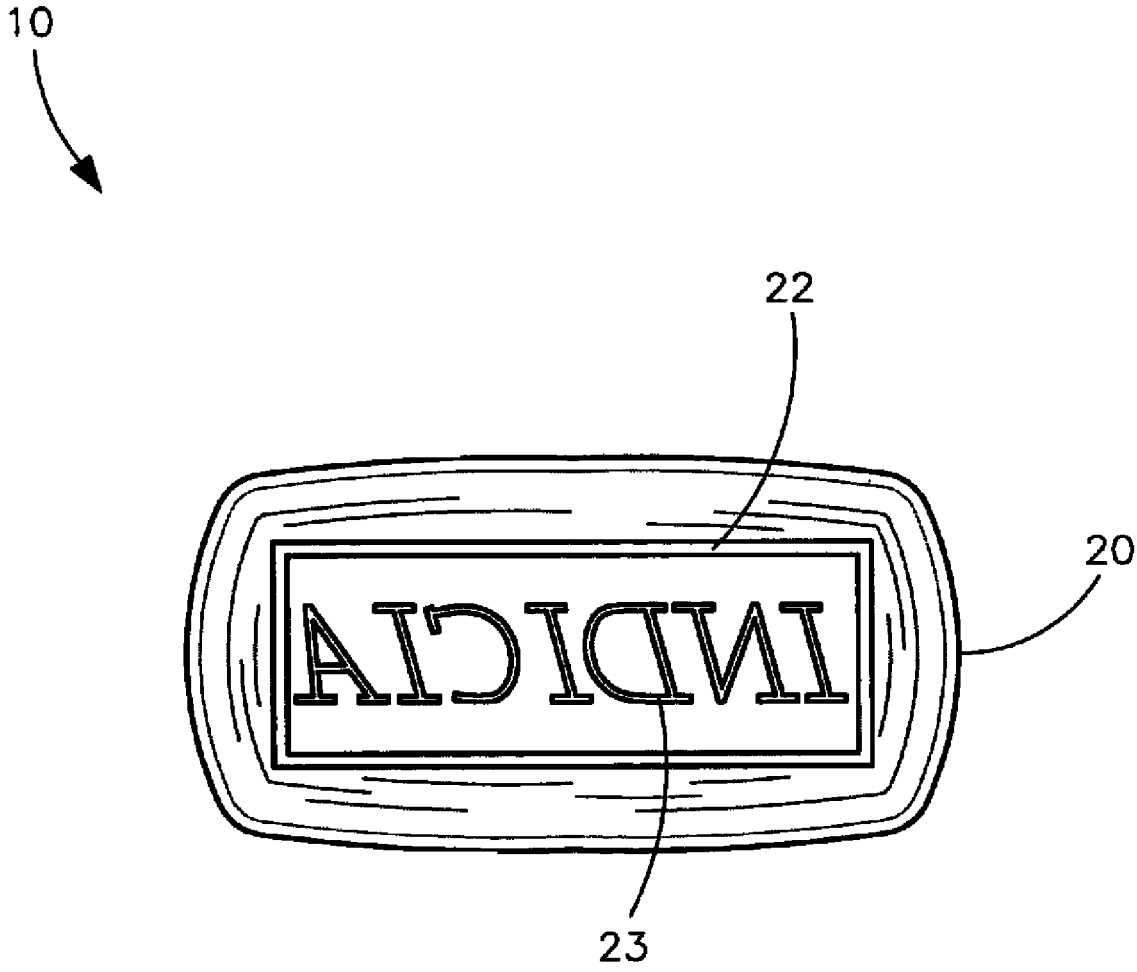
FIG. 5 is bottom-plan view of the device shown in FIG. 1.

Referring to FIGS. 3*a*, 3*b* and 6, the sensor 43 preferably includes a non-linear conductive guide pin 47 statically connected to the gear 36 and protruding outwardly therefrom. The conductive guide pin 47 synchronously rotates along the clockwise and counter clockwise directions with the gear 36. A non-linear conductive receiving pin 48 is statically coupled to the digital counter interface 42. The sensor 43 generates the true and false input signals upon detecting an engaged relationship between the conductive guide pin 47 and the conductive receiving pin 48 each time the self-inking stamp 20 is depressed. The relationship between the conductive sensor 43, the conductive guide pin 47, and the conductive receiving pin 48 provides an unexpected benefit over prior art reciprocating stamps attempts because it allows a true stamp count, since stampings that are initiated, but not completed, are not counted and displayed on the display screen 24, thus allowing a user to maintain a true stamp count.

Referring again to FIGS. 1*a* through 7, the device 10 includes a self-inking stamp 20 that has in integral self-inking mechanism. Such a self-inking mechanism includes a rubber imprint area 23 and an inkwell (not shown) that is important for extended usage. A counting mechanism 40 is included that consists of a digital counter 41 that is interconnected to the hinge-mounted internal rubber imprint area 23. Such a counting mechanism 40 automatically counts each time the self-inking stamp 20 is depressed. A display screen 24 is positioned one side of the housing 21, which is vital for conveying the number of applied stampings. For example, a device can be custom made for check endorsement. Each time the rubber imprint area 23 is applied to the back of a check to be deposited the counting mechanism 40 effectively clocks a number and displays it on the display screen 24. In this manner, a bookkeeper can conveniently keep track of how many checks are included in a single deposit, making it significantly easier to cross-reference with the number reflected on a printed adding machine tape. As such, the device 10 facilitates more accurate accounting, alleviating the risk of mistakes. The device 10 also has a reset button 46B that is crucial for allowing a user to start the digital counter 41 over for the next job. A void button 46A is also included, which is important in the case one stamping comes out unclear or uneven for allowing the user to cancel the stamping on this particular item and re-stamp it.

In use, the combined ink stamp and digital counter device 10 includes a simple and straightforward method for operation. Such a method preferably includes the steps of providing a housing 21 that has a print head 22. Next a mechanical print head actuator 30 may be provided and coupled to the print head 22. Further steps preferably include providing and coupling a counting mechanism 40 to the print head actuator 30; providing a display screen 24 electrically coupled to the counting mechanism 40; and urging the print head 22 along a linear reciprocating path defined between an upper resting position and a lower stamping position. Final steps preferably include the counting mechanism 40 counting a number of stampings when the print head actuator 30 is displaced to the lower stamping position; and conveniently displaying the number of stampings on the display screen 24.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined ink stamp and digital counter device for tracking a number of stamps made, said combined ink stamp and digital counter device comprising:

a self-inking stamp comprising a housing provided with a print head, and a mechanical print head actuator coupled to said print head for urging said print head along a linear reciprocating path;

a counting mechanism coupled to said print head actuator and being configured to count a number of stampings when said print head actuator is displaced to a lower stamping position;

a display screen electrically coupled to said counting mechanism and being configured to display said number of stampings;

wherein said counting mechanism comprises a digital counter and a digital counter interface coupled thereto, said digital counter interface comprising a conductive sensor in communication with said printer head actuator, a user interface electrically coupled to said digital counter, and a logic gate electrically coupled to said digital counter and further being in communication with said user interface and said sensor respectively;

wherein said conductive sensor generates and transmits true and false input signals to said logic gate when said self-inking stamp is depressed.

2. The combined ink stamp and digital counter device of claim 1, wherein said user interface comprises: a void button and a reset button that generate and transmit respective true input signals to said logic gate when said reset and void buttons are not engaged, said void and reset buttons respectively generate and transmit false input signals to said logic gate when said reset and void buttons are engaged and thereby respectively setting a count of said counting mechanism to zero and canceling a count of said counting mechanism respectively;

wherein said digital counter is directly connected to said display screen to visually display said number of stampings.

3. The combined ink stamp and digital counter device of claim 2, wherein said logic gate generates and transmits a true output signal to said digital counter when both of first and second input signals are true for adding a count to said number of stampings, wherein said logic gate generates and transmits a false output signal to said digital counter when either of said first and second input signals are false for subtracting a count from said number of stampings.

4. The combined ink stamp and digital counter device of claim 2, wherein said print head actuator comprises:

a rectilinear shaft connected to said housing and a rubber imprint area respectively;

a first bar traversing said rectilinear shaft and slidably coupled thereto;

a spring member having a top end fixedly anchored to said first bar;

a second bar fixedly coupled to said spring member such that said spring member is intercalated between said first and second bars;

wherein said rubber imprint area is linearly reciprocated along an axial path when said shaft and said second bar are urged downwardly, said spring member being adapted to an extended position such that said rubber imprint area automatically return to equilibrium when said shaft and said second bar are released.

5. The combined ink stamp and digital counter device of claim 4, wherein said print head actuator further comprises:

a plurality of teeth formed along a portion of said shaft;

a gear rotatably and continuously interfitted with said teeth and being configured in such a manner that said gear rotates along clockwise and counter clockwise directions when said shaft is upwardly and downwardly displaced respectively.

6. The combined ink stamp and digital counter device of claim 5, wherein said sensor comprises:

a non-linear conductive guide pin statically connected to said gear and protruding outwardly therefrom, said conductive guide pin synchronously rotating along said clockwise and counter clockwise directions with said gear; and a non-linear conductive receiving pin statically coupled to said digital counter interface;

wherein said sensor generates said true and false input signals upon detecting an engaged relationship between said conductive guide pin and said conductive receiving pin each time said self-inking stamp is depressed.

7. A combined ink stamp and digital counter device for tracking a number of stamps made, said combined ink stamp and digital counter device comprising:

a portable self-inking stamp comprising a housing provided with a print head;

a mechanical print head actuator coupled to said print head for urging said print head along a linear reciprocating path defined between an upper resting position and a lower stamping position;

a counting mechanism coupled to said print head actuator and being configured to count a number of stampings when said print head actuator is displaced to said lower stamping position;

a display screen electrically coupled to said counting mechanism and being configured to display said number of stampings;

wherein said counting mechanism comprises a digital counter and a digital counter interface coupled thereto, said digital counter interface comprising a conductive sensor in communication with said printer head actuator, a user interface electrically coupled to said digital counter, and a logic gate electrically coupled to said digital counter and further being in communication with said user interface and said sensor respectively;

wherein said conductive sensor generates and transmits true and false input signals to said logic gate when said self-inking stamp is depressed.

8. The combined ink stamp and digital counter device of claim 7, wherein said user interface comprises: a void button and a reset button that generate and transmit respective true input signals to said logic gate when said reset and void buttons are not engaged, said void and reset buttons respectively generate and transmit false input signals to said logic gate when said reset and void buttons are engaged and thereby respectively setting a count of said counting mechanism to zero and canceling a count of said counting mechanism respectively;

wherein said digital counter is directly connected to said display screen to visually display said number of stampings.

9. The combined ink stamp and digital counter device of claim 8, wherein said logic gate generates and transmits a true output signal to said digital counter when both of first and second input signals are true for adding a count to said number of stampings, wherein said logic gate generates and transmits a false output signal to said digital counter when either of said first and second input signals are false for subtracting a count from said number of stampings.

10. The combined ink stamp and digital counter device of claim 8, wherein said print head actuator comprises:

a rectilinear shaft connected to said housing and a rubber imprint area respectively;

a first bar traversing said rectilinear shaft and slidably coupled thereto;

a spring member having a top end fixedly anchored to said first bar;

a second bar fixedly coupled to said spring member such that said spring member is intercalated between said first and second bars;

wherein said rubber imprint area is linearly reciprocated along an axial path when said shaft and said second bar are urged downwardly, said spring member being adapted to an extended position such that said rubber imprint area automatically return to equilibrium when said shaft and said second bar are released.

11. The combined ink stamp and digital counter device of claim 10, wherein said print head actuator further comprises:

a plurality of teeth formed along a portion of said shaft;

a gear rotatably and continuously interfitted with said teeth and being configured in such a manner that said gear rotates along clockwise and counter clockwise directions when said shaft is upwardly and downwardly displaced respectively.

12. The combined ink stamp and digital counter device of claim 11, wherein said sensor comprises:

a non-linear conductive guide pin statically connected to said gear and protruding outwardly therefrom, said conductive guide pin synchronously rotating along said clockwise and counter clockwise directions with said gear; and a non-linear conductive receiving pin statically coupled to said digital counter interface;

wherein said sensor generates said true and false input signals upon detecting an engaged relationship between said conductive guide pin and said conductive receiving pin each time said self-inking stamp is depressed.

* * * * *